United States Patent [19]

Tani et al.

[11] 4,418,103

[45] Nov. 29, 1983

[54] FILLING MATERIAL AND PROCESS FOR MANUFACTURING SAME

[75] Inventors: Masami Tani, Kurashiki; Tamemaru Esaki, Takatsuki; Yoshikata Ohno, Asaguchi, all of Japan

[73] Assignee: Kuraray Co., Ltd., Kurashiki, Japan

[21] Appl. No.: 355,859

[22] Filed: Mar. 8, 1982

[30] Foreign Application Priority Data

Jun. 8, 1981 [JP] Japan ..... 56-88559

[51] Int. Cl.[3] ..... D02G 1/00; D04D 7/06

[52] U.S. Cl. ..... 428/4; 156/183; 156/250; 156/251; 156/296; 156/305; 428/6; 428/90; 428/91; 428/93; 428/97; 428/360; 428/362; 428/402

[58] Field of Search ..... 428/4, 6, 90, 91, 93, 428/97, 360, 362, 402; 28/147; 156/183, 250, 251, 296, 305

[56] References Cited

U.S. PATENT DOCUMENTS

| | | | |
|---|---|---|---|
| 2,713,547 | 7/1955 | Frederick | 428/6 |
| 3,373,455 | 3/1968 | Kaplan | 428/6 |
| 3,892,909 | 7/1975 | Miller | 428/6 |
| 4,065,599 | 12/1977 | Nishiumi | 428/6 |
| 4,146,674 | 3/1979 | Salamon et al. | 428/362 |
| 4,188,429 | 2/1980 | Broconnier et al. | 428/90 |
| 4,259,400 | 3/1981 | Bolliand | 428/6 |
| 4,281,042 | 7/1981 | Pamm | 428/362 |

FOREIGN PATENT DOCUMENTS

| | | |
|---|---|---|
| 45-305 | 1/1970 | Japan . |
| 47-17344 | 5/1972 | Japan . |
| 48-7955 | 3/1973 | Japan . |
| 51-39134 | 10/1976 | Japan . |

*Primary Examiner*—James C. Cannon

*Attorney, Agent, or Firm*—Barry Kramer

[57] ABSTRACT

This invention relates to filling material composed of crimped fibers joined together at one end with a high density, and having crimps located in mutually deviating phases, while the other ends of the fibers stay free, and a process for manufacturing such filling material. The filling material exhibits superior bulkiness and thermal insulation, since the recovery force or resiliency of the crimps located in mutually deviating phases causes the fibers to spread sufficiently to contain a large quantity of air among themselves.

11 Claims, 3 Drawing Figures

FILLING MATERIAL AND PROCESS FOR MANUFACTURING SAME

BACKGROUND OF THE INVENTION

This invention relates to filling material composed of synthetic fibers for use in coats, gloves, bedclothes, and the like, and to a process for manufacturing such filling material.

Various kinds of natural or synthetic filling material are known. Natural feather or down, e.g. from water fowl, is an excellent filling material having a number of outstanding properties, including bulkiness, good heat insulation, softness, resiliency, moisture absorption and permeation. Natural feather or down has, however, several disadvantages. For example, a lot of steps are required for processing natural feather or down, since it is highly susceptible to damage by insects and microorganisms. Natural feather and down is also expensive, since it is available only in limited quantities. Further, very fine powdery fragments of down or feathers are likely to induce an allergic reaction. These and other problems have prompted research on novel fibrous materials to develop substitutes for natural feather or down. It has, for example, been proposed to manufacture downlike material by bonding filaments into bundles and cutting them, as taught in Japanese Patent Publication No. 7955/1973; to partially bundle and bond short fibers as taught in Japanese Utility Model Publication No. 27227/1969; to form fibers into a spherical shape as taught in Japanese Patent Publication No. 39134/1976; and to flock fibers by electrodeposition as taught in Japanese Patent Publication No. 17344/1972. It has also been proposed, in Japanese Patent Publication No. 305/1970 to manufacture featherlike material by bonding parallel bundles of fibers with adhesive fibers. No such downlike or featherlike material is, however, commercially available, apparently because no material that is comparable to natural material in physical properties has heretofore been obtained. It is, for example, very difficult to prepare down artificially, since natural down is composed of 20 to 200 barbs grown from a rachis, and having a length of 3 to 30 mm with an average length of 14 mm, and one or two barbules grown on each barb for every 100 microns of its length. Moreover, down substitutes are considered difficult to manufacture continuously at a low cost. For example, in the process for manufacturing filling material by bonding a bundle of filaments by adhesion or melt adhesion intermittently along the length thereof, cutting the bundle into a plurality of masses, and opening the filaments, it is very difficult to bond the filaments in the center of the bundle, or even virtually impossible to do so if the filaments have a high total denier. Also, the adhesion of filaments to each other is likely to occur in lines along the length thereof. It is very difficult to open those filaments, and obtain therefrom filling material having the desired high degree of thermal insulation and bulkiness. For example, the filling material obtained at an opening rate of, say, 10% has only a bulkiness of, say, 30 cm/g. It is definitely inferior to natural feather or down, and of low commercial value even if it is used for filling a guilt or mattress. If the opening of fibers is insufficient, the bundles of fibers have difficulty in moving individually in the filling material, and are likely to get entangled together forming a ball in a guilt. Therefore, it is impossible to obtain filling material which is comparable to natural feather or down. The process which forms fibers into a spherical shape, the process which employs flocking by electrodeposition, and the process for manufacturing featherlike filling material by bonding parallel bundles of fibers with adhesive fibers are all complicated, and low in productivity. The process which bundles and partially bonds short fibers has the disadvantage that it does not lend itself to continuous mass-production. Down-like cut fibers having coiled crimps, and mixtures of down with such fibers are already commercially available. These products, however, differ from natural down in structure, and have only two-dimensional structure. Moreover, such fibers are long, and likely to form balls.

The present invention results from extensive research which was undertaken to develop a process for the industrial manufacture of filling material which is similar to natural feather or down (particularly down) in both structure and physical properties.

SUMMARY OF THE INVENTION

In accordance with the present invention, a filling material is provided comprising a multiplicity of crimped monofilaments having a fineness of 0.05 to 30 denier, a crimp number of 3 to 25 per inch, a crimping rate of at least 5%, and a length not greater than 50 mm, which are bonded together at one end to achieve a density of 30,000 to 1,500,000 denier/cm$^2$ in such a manner that their crimp phases may be deviated from one another. The present invention also provides a process for manufacturing such a filling material.

DETAILED DESCRIPTION OF THE INVENTION

Figure 1:
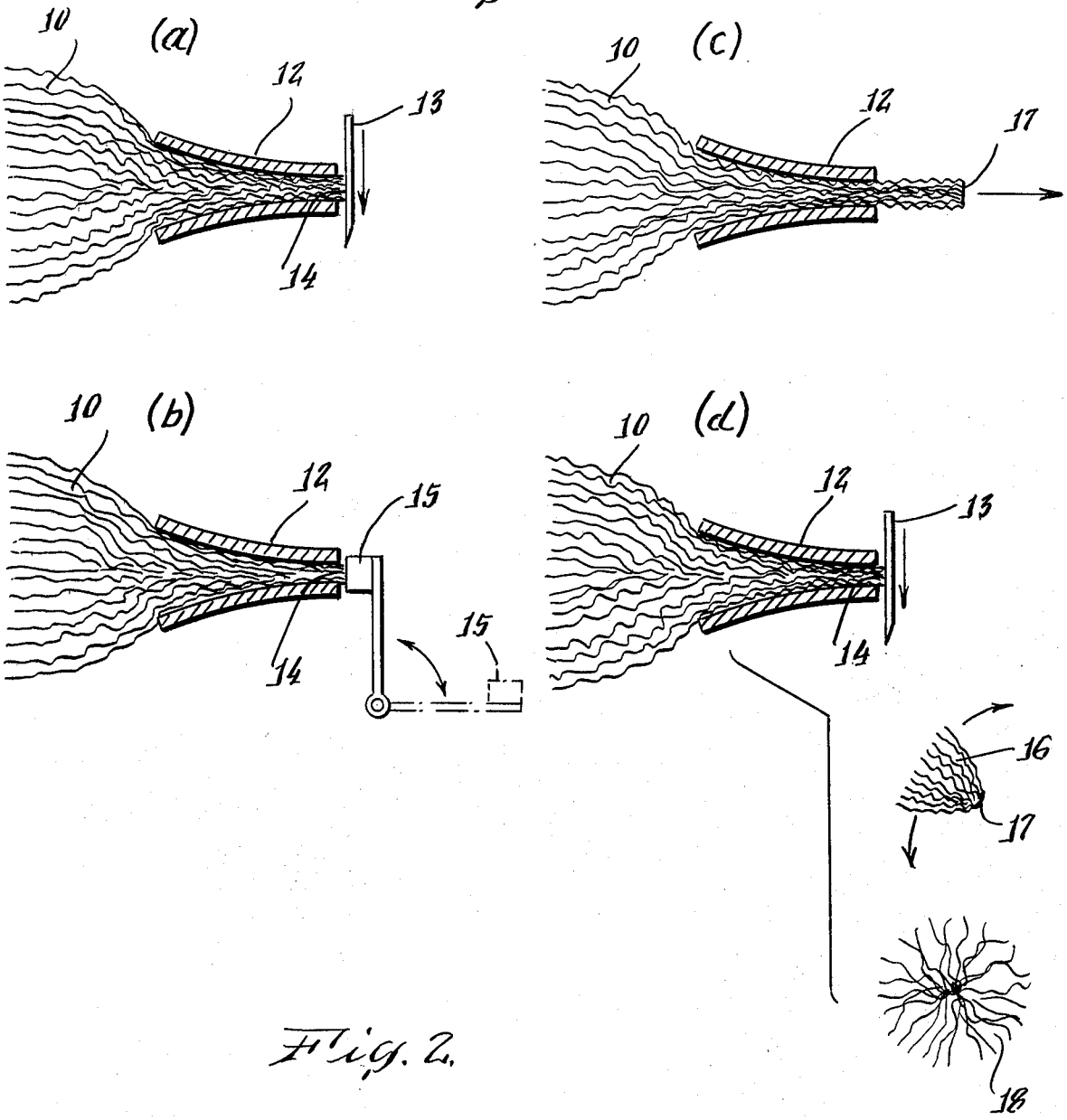
FIG. 1 is a schematic illustration of a process for manufacturing filling materials in accordance with the present invention.
Figure 2:
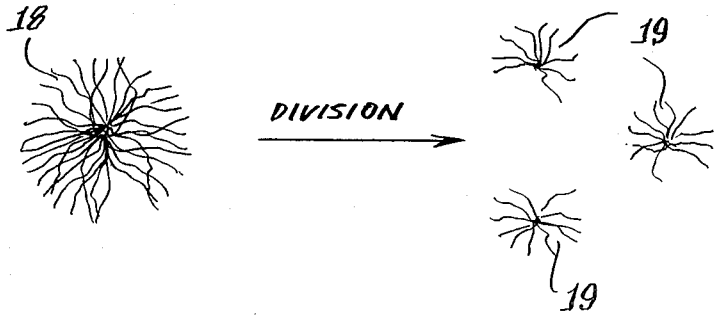
FIG. 2 is a schematic illustration of further processing in accordance with the present invention.

The process of this invention will now be set forth with reference to the drawings in order to facilitate its understanding. FIGS. 1 and 2 schematically illustrate the processes for the manufacture of spherical and cotton-like filling materials according to this invention. A tow bundle of synthetic fibers is prepared by a known method. According to this invention, it is necessary to employ a tow bundle of crimped fibers, since the crimps of the fibers per se are utilized when the fibers are opened. The tow bundle is opened in such a manner that the filaments may have their crimps located in mutually deviating phases as far as possible. The opened tow bundle is shown at 10 in FIG. 1. The tow bundle 10 is compressed into a narrow slip or groove 12, and its leading end is cut by a cutter 13, as shown in FIG. 1 at (a). Tow bundle 10 is maintained in its compressed position, and the fibers are fused together at the cut end 14 of the bundle. Fusing is accomplished by a heating member 15 having a sufficiently high temperature to fuse the fibers together. Heat from heating member 15 is applied to the cut end 14 of the bundle as shown FIG. 1 at (b). Alternatively, fusing can be accomplished by exposing cut end 14 directly to a flame. The tow bundle 10 is then pushed or pulled out of the slit or groove 12 as shown in FIG. 1 at (c) until a desired length (corresponding to that of filaments forming the final cotton-like wadding or filling material) is obtained. Then, the exposed portion of the tow bundle is cut off by a knife 13, as shown in FIG. 1 at (d), whereby a tip 16 is obtained. The tip 16 is comprises a fully opened bundle of crimped fibers compressed temporarily by the slit or groove 12 to obtain a high fiber density at its fused and cut end 17. When the tip 16 is cut away by knife 13, the fibers are released from constriction by the slit or groove 12, at which time they instantaneously spread spherically or radially about the fused end 17 thereof by virtue of the restorative or repulsive force of the crimps to form a ball of fibers 18. After the tip 16 has been cut away during step (d), the remaining tow bundle 10 stays in its compressed position at its leading end as shown at (a).

Therefore, if the steps (b) to (d) are repeated, it is possible to produce balls of fibers 18, as shown, continuously on a commercial basis. While the balls 18 are themselves suitable as filling material, they can also be divided at their fused ends by an appropriate separating machine, such as an opener, to form cotton-like material 19 which resembles natural down, as shown in FIG. 2.

The various conditions for the manufacturing process as hereinabove outlined will now be described. According to this invention, it is possible to employ fibers having any crimp configuration, such as mechanically obtained corrugated crimps, or coil crimps obtained by the asymmetrical cooling, or conjugate spinning method. It is, however, preferable to use fibers having coil crimps in view of the opening property of their tow bundle, their resiliency or recovery from compression, and the pressure resistance of the filling material thereby formed. It is preferable that the fibers have 3 to 25 crimps, or more preferably 5 to 15 crimps, per inch of their length. It is necessary that the fibers have a crimping rate of at least 5%. If the number of crimps, or the crimping rate is too small or low, the tow bundle fails to form a fully opened fiber structure when it is released from compression. The use of fibers having too many crimps should also be avoided, since bundles formed therefrom will not sufficiently open. If the bundle is not sufficiently opened, the filling material obtained therefrom lacks the bulkiness which is required of wadding to be used, e.g., in bedclothes.

The tow bundle has to be opened at a a rate of at least 30%, or preferably at least 50%, before it is compressed. The "opening rate" is represented by the formula:

$$(5-X)/5\times 100$$

in which X stands for the weight of fibers gathered in the form of a tip formed by more than five fibers in 5 grams of a sample. An opening rate of less than 30% indicates that the tow bundle will not sufficiently open when released from compression, such that the fibers will remain substantially in the form of a tip which is merely a bundle of parallel fibers. Such a mass of fibers is difficult to open sufficiently by any known method, even if it is separated into smaller units and formed into tow bundles of fibers having crimps located in mutually deviating phases; therefore, it is difficult to produce filling material having outstanding properties from tow bundles having opening rates below 30%.

In the process of the present invention, the tow bundles of crimped fibers may be opened by any appropriate method known to those skilled in the art. For example, the tow bundle can be quickly passed through a drafting zone having a pair of front and rear drafting rolls, and immediately thereafter be released from the drafting force. In order to obtain an acceptable opening rate, it is desirable to blow compressed air against the tow bundle simultaneously with the releasing thereof from the drafting force.

The tow bundle can be cut by any method known, but it must be held firmly during the cutting step. It is also desirable to allow the fibers to open as widely apart from one another as possible after they have been released from compression. In this connection, it is desirable that the fibers have only a thin layer of melt adhesion at the end of the tow bundle. Therefore, the ends of the individual fibers should form as even a surface as possible at the end of the tow bundle where the fibers are held together by melt adhesion. In order to form such a thin and even layer of melt adhesion, and simplify the apparatus required therefor, it is preferable to maintain the tow bundle in its compressed position throughout its cutting and melt adhesion.

The tow bundle is compressed to enable the fibers to be held together by melt adhesion at a high fiber density, so that the fibers may spread satisfactorily by virtue of the resiliency of their crimps when the tow bundle has been released from compression. Therefore, the compression of the opened tow bundle may be effected by any method as long as it is possible to compress its cut end and maintain it in the compressed position while the fibers are being joined by melt adhesion.

It is necessary to compress the cut end of the tow bundle to such an extent that a fiber density of 30,000 to 1,500,000 denier/cm$^2$, or preferably 100,000 to 700,000 denier/cm$^2$, may be obtained thereat. If the fiber density is less than 30,000 denier/cm$^2$, the resiliency of the crimps will be too low to permit the fibers to spread sufficiently when they are released from compression. In such a case, more than a tip which is merely a bundle of parallel fibers, lacking bulkiness, will be obtained. Such a bundle of parallel fibers is capable of containing only a small amount of air therein, and will fail to provide any satisfactory thermal insulation as required. A fiber density exceeding 1,500,000 denier/cm$^2$ is also undesirable in view of the resulting limitation in the resiliency or recovery force of the crimps, and the requirement for very large apparatus to process tow bundles having such fiber densities. The use of a narrow slit or groove has already been described as one technique for compressing the tow bundle. Alternatively, it is possible to employ a tow fixing device in a cutter to accommodate a very thick tow having a combined fiber fineness of 500,000 to 10,000,000 denier.

The fibers are joined together by melt adhesion in as thin a layer as possible at the cut and compressed end of the tow bundles, as already described. Alternatively, the fibers may be joined together by any other appropriate method, including the use of a bonding agent, or a solvent which dissolves the ends of the fibers into adhesion. In whichever method is employed, it is desirable to avoid the formation of a thick layer of adhesion along the length of the fibers. A thin layer of adhesion, only at the cut end of the tow bundle, is required in order to ensure that the fibers can easily spread when released from compression. Any method adopted for adhesion must also have sufficient strength to facilitate division of the product into smaller units while preventing any inadvertent separation. As will be clear to those skilled in the art, the actual degree of adhesion must be controlled to suit the capacity of the apparatus which is used for dividing the product into smaller units. In view of the foregoing, melt adhesion by heat would be the most suitable from the standpoint of industrial application. Such melt adhesion by heating the fibers may be accomplished simultaneously with the cutting of the tow bundle by using a laser beam.

The end surface of the tow bundle at which the fibers are joined together by melt adhesion, or otherwise, may be of any shape, e.g. circular, oval, rectangular or diamond. An elongated shape is preferred from the standpoint of ease of opening.

A predetermined length of the tow bundle is pushed or pulled out of the compression slit or groove (e.g. slit 12 shown in FIG. 1), or other means by which it is maintained in its compressed position, and cut away. The tip thus obtained spread by virtue of the recovery force or resiliency of the crimps on the fibers to form a generally spherical or semispherical, or otherwise three-dimensional shape. The tip may have a length not exceeding 50 mm, or preferably a length of 5 to 30 mm. The fibers may have a uniform length in the range of 3 to 50 mm, or be of different length in that range. If the fiber length is less than 3 mm, the resulting fiber product will be too rigid to exhibit the intended compressibility and thermal insulation. If such length is greater than 50 mm, a fiber product will be obtained which is too big to form any suitable filling material. It is further advantageous to use fibers having different lengths in order to make fiber products of various shapes which spread in various patterns. Fibers having a uniform length may be obtained if a cutter is applied to the two bundles at right angles thereto, while the fibers having different lengths can be obtained if the cutter is applied at an angle to the tow bundle, whether horizontally or vertically thereto.

The fiber product obtained will be generally in the form of a ball and may be divided into smaller units by tearing mechanically, applying a jet of gas, or otherwise using an appropriate separating machine. The result will be a number of pieces of downlike filling material composed of different numbers of fibers joined together at one end thereof. Each such piece of downlike filling material may, for example, comprise 10 to 200 fibers.

The generally spherical fiber product thus obtained has a center from which the fibers joined together extend radially, and is itself very high in compessibility. The fibers are joined together at one end thereof by a thin layer of adhesion in which they have a density of 30,000 to 1,500,000 denier/cm$^2$, and their crimps are located in mutually deviating phases. The spherical product will contain fibers which are spread very widely, and will thereby be resilient against the pressure acting thereon from any direction, and be far higher in resistance to pressure than any filling material known heretofore, since the fibers have a higher density toward the center of the product.

These fiber products are individually movable, and provide filling material which will closely fit the skin. The spherical fiber products having a diameter not greater than 50 mm, and particularly, those having a diameter not exceeding 30 mm make it possible to manufacture a guilt or mattress easily and economically, since they can easily be stuffed into a tick by a jet of gas in a manner which is conventional in the manufacture of a feather guilt or mattress. The spherical fiber products are particularly suitable for filling a mattress, bed or pad. They are also suitable for filling a cushion, pillow or stuffed doll. They can also be used for filling a sofa, or the like.

The downlike filling material divided from any such spherical fiber product is also composed of fibers joined together at a high density at one end thereof, and having their crimps located in mutually deviating patterns. It is, thus, very similar to natural down, as shown by way of example in FIG. 2. The down-like filling material thus obtained is comparable to natural down in thermal insulation, bulkiness, and even superior thereto in recovery. The downlike filling material does not gather into a ball, but retains the outstanding properties as required for the purpose for which it is used. The variations in the number of the individual fibers, and in the pattern in which they spread create the physical properties which resemble those of a natural product. The downlike filling material of this invention when composed of several to about 200 fibers, is comparable, or very close, to natural down in its thermal insulation properties, bulkiness and shape.

The filling material of this invention provides a feather or down substitute suitable for use in bedclothes. It is, of course, also suitable for filling guiltings, such as down jackets, sleeping bags, ski wear, and night gowns. Since it is non-allergenic, and drapes excellently as opposed to natural feather or down, it can be used for stuffing a baby gown, a vest, or the like.

According to this invention, it is advisable to use fibers having a fineness of 0.05 to 30 denier, depending on the purpose for which the filling material is used. For example, if the filling material is used for a soft next-to-skin quilt, it is advisable to employ fibers having a fineness not exceeding 10 denier, while it is desirable to use fibers having a fineness not lower than 15 denier for the filling material which is employed for a cushion, sofa, or the like. For ordinary bedclothes, pillows or quiltings, it is suitable to use fibers having a fineness in the range of 0.5 to 15 denier, or preferably 1 to 10 denier, as they provide the filling material which exhibits the best handle. It is also effective to employ a mixture of fibers of different denier in order to obtain a further improved handle and thermal insulation property. While the fibers may have a circular, hollow or modified cross section, it is preferable to use fibers having a modified cross section, such as T- or U-shaped, or plus sign-shaped, dog bone-shaped, or asterisk-shaped, in order to improve the opening properties of the fibers. Fibers having a U-shaped cross section, which absorb moisture, are of particular value as a filling material since they absorb sweat. Various kinds of fibers which are different in fineness and cross-sectional shape may be mixed together to form a tow from which filling material will be manufactured according to the process of this invention.

According to this invention, it is preferable to use fibers having a static frictional coefficient not higher than 0.27, or more preferably not higher than 0.23. In this connection, coating the fiber surfaces with a silicon compound, or the like, is desireable. A known silicon compound, such as dimethyl polysiloxane or modified siloxane, can be used. Such a compound may be applied to the fibers either before they are formed into bundles, or thereafter.

In accordance with this invention, it is possible to use synthetic fibers obtained by conjugate or mixed spinning from, for example, terephtharate polyesters or copolymers thereof, aliphatic or aromatic polyamides, polyolefin compounds, polyvinyl compounds, polyacrylonitrile compounds, or vinyl chloride compounds. The fibers of terephtharate polyesters or their copolymers are superior to any other fibers in physical properties. The most typical polyester fibers comprise polyethylene terephtharate, or its copolymer. The fibers may contain known coloring, antistatic, fire retarding, or other agents.

This invention provides an economically advantageous process which is easy to carry out industrially, and provides inexpensive products of uniform quality.

EXAMPLE 1

Figure 3:
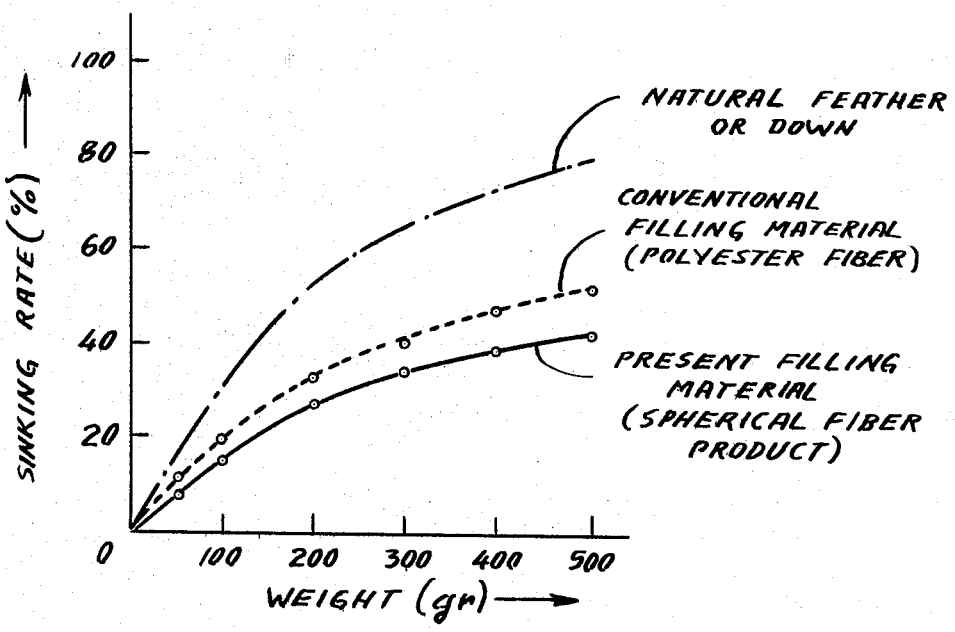
FIG. 3 is a graph which compares the pressure resistance of the filling of the present invention to that of prior filling materials.

Polyethylene terephtharate prepared by a customary method, and having an intrinsic viscosity of 0.65 as determined at 30+ C. in a mixed solution containing equal quantities of phenol and tetrachloroethane was melted, and extruded through a nozzle having a U-shaped cross section. The extruded product was cooled by blowing air thereagainst in one direction at a point 5 to 20 cm below the nozzle at a rate of 1.5 m/sec, and wound. The extruded fibers were bundled, and stretched at a ratio of 2.8 in a bath of water having a temperature of 80° C. to for a tow of fibers having a U-shaped cross section. Applied to the tow was 0.75% by weight of a silicon compound comprising: (a) 9 parts of a 30% by weight aqueous emulsion of polysiloxane ($\eta^{25}$=6,000,000 cs); (b) 1.2 parts of a 20% by weight aqueous emulsion of γ-(γ-aminoethyl) aminopropylmethyldimethoxysilane; and (c) 1 part of a 10% aqueous solution of zirconium acetate. Then, the fibers were heat treated at 150° C., and crimped. The fibers thus obtained showed a fineness of 4 denier, and had seven coiled crimps per inch. The tow was, then, placed under tension between a pair of rolls having a speed ratio of 1:2, and compressed air was blown against the tow while it was released from tension, whereby the tow was opened. The opening rate of the tow turned out to be 92%. The opened tow having a combined fineness of 1,050,000 denier was introduced into a groove having a rectangular cross section tapered toward its outlet, and adapted to compress the fibers at a density of 350,000 denier/cm$^2$ at its outlet. The leading end of the tow was cut away to present an even end surface. A hot plate having a temperature of 260° C. was kept in contact with the cut end surface of the tow for 0.7 second to join the fibers together by melt adhesion. The tow was, then, pushed out of the outlet of the groove, and cut away to form a tip having a length of 15 mm, whereupon the fibers instantaneously spread radially about one end of the tip to form a spherical mass as shown at 18 in FIG. 1 or 2. The spherical fiber products thus obtained were used to make a 40 cm square test quilt, and its properties were examined. FIG. 3 shows the pressure resistance of the test quilt. As is obvious from FIG. 3, the filling material of this invention showed higher pressure resistance than natural feather or down, and conventional filling material composed of polyester fibers.

The spherical fiber mass was, then, passed twice through a mechanical opener, and divided at the end of melt adhesion into a plurality of smaller cotton-like masses as shown at 19 in FIG. 2. The cotton-like material 19 thus obtained was composed of about a dozen to 200 fibers, and had a shape closely resembling natural down. Microscopic inspection of the cotton-type material 19 indicated mutually deviating phases of crimps on the fibers, and full expansion of the fibers into a mass defining a large layer of air therein.

The cotton-type material 19 was formed into a 40 cm square test quilt by using a blowing machine for metering feather or down (product of YAMAICHI SEWING MACHINE INDUSTRIAL CO., Japan). The quilt was evaluated for bulkiness (mm), recovery rate (%), thermal insulation, and gathering resistance. Evaluation results pertaining to the cottontype material 19 are given in Table 1 below, wherein the material 19 of the present invention is designated by the letter "E". Evaluation was also made under the same conditions of three typical kinds of down "A", "B" and "C", typical polyester filling material "D" known in the art, and two other types of filling material "F" and "G" according to this invention. Materials "F" and "G" were different from the filling material "E" only in length. The results are shown in TABLE 1.

TABLE 1

| Filling material | | Bulki-* ness (mm) | Recovery** rate (%) | Thermal*** insulation (CLO) | Gathering**** resistance |
|---|---|---|---|---|---|
| A | Down (high grade) | 82.0 | 70.9 | 5.31 | o |
| B | Down (medium grade) | 76.3 | 60.0 | 4.19 | o |
| C | Down (low grade) | 52.9 | 65.9 | 3.15 | o |
| D | Polyester filling material $6^{dr}$ × 15 mm | 51.0 | 69.3 | 3.24 | x |
| E | Invention $4^{dr}$ × 15 mm | 70.8 | 71.0 | 4.03 | o |
| F | Invention $4^{dr}$ × 25 mm | 74.5 | 74.6 | 4.25 | o |

TABLE 1-continued

| Filling material | Bulki-* ness (mm) | Recovery** rate (%) | Thermal*** insulation (CLO) | Gathering**** resistance |
|---|---|---|---|---|
| G Invention $4^{dr} \times 35$ mm | 78.8 | 71.4 | 4.59 | o |

*Bulkiness: 70 grams of each sample were blown into a 40 cm square tick by a blowing machine, and a test quilt was formed manually. The test quilt was dried for 30 minutes in a drier having a temperature of about 70° C., and then, was left for two hours in a room having a temperature of 25° C. and a humidity of 65%. A weight plate W1 measuring 30 cm square, and having a weight of 0.08 g/cm$^2$ was placed on the test quilt. The height between the weight plate W1 and each of the four corners of the quilt was measured, and an average height $h_0$ (mm) was obtained.

**Recovery rate: Another weight plate W2 was placed on the weight plate W1 on the test quilt to apply an additional load of 4.0 g/cm$^2$ for five minutes, and after the weight plate W2 had been removed, the quilt carrying the weight plate W1 thereon was left for five minutes. The procedures were repeated five times. Then, the height between weight plate W1 and each corner of the quilt carrying the weight plate W1 and W2 thereon was measured, and an average height $h_1$ (mm) was obtained. After the weight plate W2 had been removed, and the rest had been left for five minutes, the height between each corner of the quilt and the weight plate W1 was measured again, and an average height $h_2$ (mm) was obtained. The recovery rate was calculated in accordance with the following equation:

$$\text{Recovery rate (\%)} = \frac{h_2 - h_1}{h_0 - h_1} \times 100$$

***Thermal insulation: The thermal insulation (CLO) of 50 grams of each sample was determined in accordance with the equation shown below. The sample was stacked in a 30 cm square box, and a load of 0.18 g/cm$^2$ was placed on the sample. The test was conducted by using an ASTM thermal insulation tester (product of TOYO SEIKI, Japan) in a temperature controlled room having a temperature of 20° C. to 25° C., a humidity of about 65%, and an air flow of 15 to 20 ft./mm. The quantity of heat released by the sample in an hour was measured.

$$\text{CLO} = \left(\frac{0.949 \times a}{b} - 0.881\right)$$

where a: Quantity of heat released under no load (Kcal/h);
b: Quantity of heat relased by the sample (Kcal/h).

****Gathering resistance: After the quilt had been beaten 2,000 times, inspection was made visually of the quilt to see whether the fibers had gathered to form balls.
o: The fibers remained in order;
x: The fibers were broken, and gathered to form a lot of balls.

The filling material of this invention was found to be superior to the conventional product in bulkiness, thermal insulation and gathering resistance, and very close to natural feather or down in various properties. A quilt measuring 150 cm by 200 cm, and containing 1.8 kg of filling material was made by employing the filling material of this invention, and found substantially as soft as a natural feather or down quilt. Moreover, the filling material of this invention showed a very high degree of workability without presenting any problem throughout the process of its manufacture and application.

EXAMPLE 2

Eight kinds of filling material were prepared from the tow obtained in EXAMPLE 1 in accordance with the method employed in EXAMPLE 1, except that the opening rate and compression density of the tow were varied. The tow was composed of fibers having a fineness of 4 denier, and seven coiled crimps formed at a crimping rate of 10.3% per inch of fiber length, and had a combined fineness of 750,000 denier. The samples thus prepared were evaluated for bulkiness and recovery from compression. The results are shown in TABLE 2 below.

TABLE 2

| Sample No. | Opening rate (%) | Compression density (× 10,000 dr/cm$^2$) | Bulki-ness (mm) | Recovery rate (%) |
|---|---|---|---|---|
| 1 (Comparative) | 20.8 | 35 | 41.0 | 62.0 |
| 2 (Invention) | 52.0 | " | 61.8 | 66.8 |
| 3 (In) | 70.4 | " | 69.0 | 68.0 |
| 4 (In) | 82.9 | " | 75.0 | 71.1 |
| 5 (In) | 100 | " | 78.8 | 71.4 |
| 6 (In) | 85.0 | 10.5 | 70.4 | 65.0 |
| 7 (Com) | 24.5 | 2.3 | 28.8 | 58.0 |

TABLE 2-continued

| Sample No. | Opening rate (%) | Compression density (× 10,000 dr/cm$^2$) | Bulki-ness (mm) | Recovery rate (%) |
|---|---|---|---|---|
| 8 (Com) | 80.6 | " | 51.2 | 60.3 |

In: Invention;
Com: Comparative.

As shown by Comparative Samples Nos. 1, 7 and 8 in TABLE 2, the filling material obtained from the tow prepared at a low opening rate or compression density was found very low in bulkiness, and even inferior to the down of low grade shown in TABLE 1 in EXAMPLE 1. All of the products shown as Comparative Samples Nos. 1, 7 and 8 were substantially in the form of a tip, and exhibited only an unsatisfactory handle.

Samples Nos. 2 to 6 of this invention, which had been obtained from the tow prepared at a high opening rate and a high compression density, were all fully satisfactory in bulkiness and recovery rate, and showed a handle which was very close to that of natural feather or down. In all of the products according to this invention, the fibers had crimps located in mutually deviating phases, were joined together in a uniform layer of adhesion, and were in a widely spread shape confining a large layer of air therein.

EXAMPLE 3

Polyethylene terephtharate having an intrinsic viscosity of 0.65 as determined at 30° C. in a mixed solution containing equal quantities of phenol and tetrachloroethane was melted, and extruded through a nozzle having a circular cross section and kept at a temperature of 290° C. The extruded product was cooled by air blown thereagainst in one direction at a point 5 to 20 cm directly below the nozzle at a rate of 0.5 to 3.5 m/sec., and wound. Five kinds of fibers were prepared in this way. The fibers of each kind were bundled into a tow, and the tow was stretched at a ratio of 2.8 in a bath of water having a temperature of 80° C. Then, the tow was heat treated at 150° C., and the fibers were crimped. The tow was placed under tension between a pair of rolls, and compressed air was blown against the tow while it was released from tension, whereby it was opened, as had been done in EXAMPLE 1.

In view of the different rates at which the fibers had been cooled, different amounts of tension were given to the tows between the rolls, and compressed air blown thereagainst at different rates to open all of the five tows at a rate of about 95%. The fibers in all of the five tows had a fineness of 6 denier.

Spherical products were formed from each of the five opened tows each having a combined fineness of 1,050,000 denier in accordance with the method by which Sample "E" had been prepared in EXAMPLE 1. The spherical products formed from each tow were divided into smaller cotton-like fragments.

A test quilt measuring 40 cm square was made by using the cotton-like filing material prepared from each tow, and evaluated for bulkiness, recovery from compression, and gathering resistance. The results are shown in TABLE 3 below.

TABLE 3

| Sample No. | Number of crimps per inch | Crimping rate (%) | Bulkiness (mm) | Recovery rate (%) | Gathering Resistance |
|---|---|---|---|---|---|
| 1 (Com) | 1.5 | 4.5 | 40.1 | 48.2 | o |
| 2 (In) | 4.6 | 5.1 | 68.8 | 67.5 | o |
| 3 (In) | 7.7 | 9.0 | 79.2 | 72.4 | o |
| 4 (In) | 12.0 | 6.0 | 61.7 | 64.9 | o |
| 5 (Com) | 26.2 | 5.5 | 30.4 | 70.1 | x |

In: Invention;
Com: Comparative.

Sample No. 1 prepared from the fibers having only a small number of crimps was inferior in bulkiness and recovery from compression, though it had a soft handle which was similar to that of natural feather or down. Sample No. 5 prepared from the fibers having too many crimps was also inferior in bulkiness and gathering resistance. This was apparently due to the poor opening of the tows obtained after they had been compressed, and released from compression. On the other hand, Samples Nos. 2 to 4 of this invention exhibited an adequate degree of resiliency, and bulkiness, gathering resistance and a soft handle which were close to those of natural feather or down.

EXAMPLE 4

Three kinds of cotton-like filling material were prepared by repeating the procedures of EXAMPLE 1, except for the method employed for joining the fibers at the cut ends of the tows, and the fiber density. Three kinds of tows were compressed at a different fiber density from one another, and the fibers were joined together at the cut end of each tow by an alphacyanoacrylate adhesive solvent sprayed thereagainst for 0.1 second, whereby spherical fiber products were obtained. The spherical products were divided into smaller fragments of cotton-like material. A test quilt measuring 40 cm square was made, as had been done in EXAMPLE 1, from the filling material prepared from each tow, and evaluated for bulkiness and recovery from compression. The results are shown in TABLE 4 below.

TABLE 4

| Sample No. | Fiber density (× 10,000 dr/cm$^2$) | Opening rate (%) | Bulkiness (mm) | Recovery rate (%) |
|---|---|---|---|---|
| 1 (In) | 53 | 94 | 77.9 | 72.6 |
| 2 (In) | 36 | 89 | 75.4 | 74.5 |
| 3 (Com) | 2.2 | 87 | 48.5 | 59.6 |

In: Invention;
Com: Comparative.

Sample No. 3, which had been prepared from a tow having an extremely low fiber density, had a very thick layer of solvent adhesion which prevented the fibers from spreading sufficiently when released from compression. The spherical products obtained from the tow could not be divided into uniform fragments of cotton-like filling material, but some fragments contained too large a mass of undivided material. On the other hand, Samples Nos. 1 and 2 of this invention, which had been prepared from tows having a sufficiently high fiber density, exhibited substantially the same properties as those of the products obtained in EXAMPLE 1, and a handle and bulkiness which were close to those of natural feather or down.

EXAMPLE 5

Polyethylene terephtharate having an intrinsic viscosity of 0.65 as determined at 30° C. in a mixed solution containing equal quantities of phenol and tetrachloroethane was melted, and extruded through a nozzle having a T-shaped cross section, and kept at a temperature of 290° C. The extruded product was cooled by air blown thereagainst in one direction at a point 5 to 20 cm directly below the nozzle at a rate of 2 m/sec., and wound. The fibers thus obtained were bundled into a tow, and the tow was stretched at a ratio of 2.8 in a bath of water having a temperature of 80° C. Then, the tow was heat treated at 150° C., and the fibers were crimped. The tow was placed under tension between a pair of rolls, and compressed air was blown against the tow while it was released from tension, whereby the tow was opened, as had been done in EXAMPLE 1. The fibers had a fineness of 14 denier, and the tow had a combined fineness of 80,000 denier. Spherical fiber products were prepared by repeating the procedures of EXAMPLE 1 for the preparation of Sample E, except that the tow end at which the fibers were joined together had a fiber density of 389,000 denier/cm$^2$, and that a length of 20 cm was cut away from the tow. The spherical products were divided into smaller fragments of cotton-like filling material. When the tip was cut from the tow, it spread instantaneously and automatically into a spherical product. Three kinds of cotton-like filling material were prepared by dividing the spherical products into different sizes.

A test quilt was made by using each kind of filling material, and a fourth quilt by using typical polyester cotton known in the art (14 dr×64 mm). The test quilts thus prepared were evaluated for bulkiness, compression properties, and gathering resistance. The results are shown in TABLE 5 below.

TABLE 5

| Sample No. | Size of filling material (number of fibers) | Bulkiness (mm) | Recovery rate (%) | Sinking* rate (%) | Gathering resistance |
|---|---|---|---|---|---|
| 1 (In) | 100–150 | 53.0 | 76.2 | 41.2 | o |

TABLE 5-continued

| Sample No. | Size of filling material (number of fibers) | Bulkiness (mm) | Recovery rate (%) | Sinking* rate (%) | Gathering resistance |
|---|---|---|---|---|---|
| 2 (In) | Approx. 2,000 | 60.9 | 74.2 | 47.4 | o |
| 3 (In) | Approx. 15,000 | 65.8 | 74.8 | 49.3 | o |
| 4 (Con) | — | 55.4 | 63.4 | 63.2 | x |

In: Invention;
Con: Conventional.

*Sinking rate $= \frac{a - b}{a} \times 100$ where a: thickness of a quilt under an initial load of 0.08 g/cm$^2$; and
b: thickness of the quilt to which an additional load of 4.0 g/cm$^2$ was applied.

The products of this invention showed a lower sinking rate, and a higher recovery rate than the conventional one. They also exhibited superior gathering resistance, or fatigue resistance.

Sofa cushions each measuring 70 cm square, and containing 1.2 kg of filling material were also prepared for testing purposes. The cushions prepared from the filling material of this invention showed superior resiliency, as compared with that employing the conventional polyester cotton.

We claim:

1. Filling material comprising a multiplicity of crimped fibers joined together at one end which spread spherically or radially about said one end, said fibers having a fineness of 0.05 to 30 denier, a crimping rate of at least 5%, and a maximum length of 50 mm, said fibers having 3 to 25 crimps per inch, said crimps being located in mutually deviating phases, and said fibers having a density of 30,000 to 1,500,000 denier/cm$^2$ at said end thereof.

2. Filling material as set forth in claim 1, wherein said filling material is composed of cotton-like fragments each composed of 10 to 200 fibers.

3. Filling material as set forth in claim 2, wherein said fibers have a fineness of 0.5 to 15 denier.

4. Filling material as set forth in claim 1, 2, or 3 wherein said fibers comprise polyester.

5. A continuous process for manufacturing filling material, said process comprising the steps of:

opening a tow of crimped fibers at a rate of at least 30%, said fibers having a fineness of 0.05 to 30 denier, a crimping rate of at least 5%, and from 3 to 25 crimps per inch;

compressing at least one end of said opened tow until said tow has a fiber density of 30,000 to 1,500,000 denier/cm$^2$ at said end thereof;

cutting said tow at said end thereof to expose a tow end surface;

joining said fibers together at said tow end surface while said tow is maintained in its compressed position;

cutting away a tow length of no more than about 50 mm from said end surface while said tow is maintained in its compressed position, whereupon said tow length is released from compression, and spreads spherically or radially about said end surface to form a spherically or radially spread fiber product; and repeating the foregoing sequence of steps to form a multiplicity of spherically or radially spread fiber products.

6. The process of claim 5 further comprising the step of opening said fiber products, and dividing each of them into smaller fragments of cotton-like filling material.

7. The process of claim 5 or 6 wherein said tow is opened at a rate of at least 50%.

8. The process of claim 5 or 6 wherein said tow has a fiber density of 100,000 to 700,000 denier/cm$^2$ at said end surface thereof.

9. The process of claim 5 or 6 wherein said fibers are joined together at said tow end surface by melt adhesion.

10. The process of claim 5 or 6 wherein said fibers are joined together at said tow end surface by solvent adhesion.

11. The process of claim 5 or 6 wherein said fibers are joined together at said tow end surface by a bonding agent.

* * * * *